US007210491B2

(12) United States Patent
Su

(10) Patent No.: US 7,210,491 B2
(45) Date of Patent: May 1, 2007

(54) UMBRELLA STRUCTURE

(76) Inventor: Ping-Tung Su, P.O. Box No. 6-57, Junghe, Taipei 235 (TW)

( * ) Notice: Subject to any disclaimer, the term of this patent is extended or adjusted under 35 U.S.C. 154(b) by 4 days.

(21) Appl. No.: 10/704,581

(22) Filed: Nov. 12, 2003

(65) Prior Publication Data

US 2005/0098200 A1 May 12, 2005

(51) Int. Cl.
*A45B 25/06* (2006.01)

(52) U.S. Cl. ..... 135/28; 135/25.1; 135/39

(58) Field of Classification Search ..... 135/28, 135/37–39, 41, 25.1
See application file for complete search history.

(56) References Cited

U.S. PATENT DOCUMENTS 5,178,174 A * 1/1993 Wu ..... 135/22
5,964,235 A * 10/1999 Wang ..... 135/28
6,382,222 B1 * 5/2002 Ko ..... 135/41
6,722,382 B2 * 4/2004 Wang ..... 135/30
6,918,399 B2 * 7/2005 Ko ..... 135/29
2004/0025913 A1 * 2/2004 Kuo ..... 135/22

* cited by examiner

*Primary Examiner*—Winnie Yip
(74) *Attorney, Agent, or Firm*—Troxell Law Office, PLLC

(57) ABSTRACT

An umbrella structure includes a cover, a shaft, a notch, a runner, main ribs and stretchers. The notch is extended downward to form a fixing portion. The fixing portion has one end disposed with a protruding loop section, and an appropriate position disposed with a fastening orifice for corresponding with the protruding button. The runner is accommodated at the fixing portion, and is capable of up-and-down sliding movements at the fixing portion. When stretching the umbrella, the protruding button at the fastening device is steadily locked at the fastening orifice at the fixing portion to smoothly stretch the umbrella. When collapsing the umbrella, the shaft is stored in the fixing portion to prevent the shaft from damages and deformations by offering the shaft with appropriate protection. Using the aforesaid structure, a drawback as being incapable of securely stretching the umbrella due to a reduced volume of the umbrella is solved.

7 Claims, 13 Drawing Sheets

UMBRELLA STRUCTURE

BACKGROUND OF THE INVENTION (a) Field of the Invention

The invention relates to an umbrella structure, and more particularly, to an umbrella structure, which overcomes drawbacks in the existing state of the art which is incapable of securely locking the fastening orifice after reducing the volume of the umbrella.

(b) Description of the Prior Art

With reference to FIGS. 1 and 1A, a prior umbrella comprises a cover 11, a shaft 12, a notch 13, a runner 14, main ribs 15 and stretchers 16. Around the notch 13 is a plurality of pivotally disposed main ribs 15 for supporting the cover 11, whereas around the runner 14 is a plurality of pivotally disposed stretchers 16 for supporting the main ribs 15. The shaft 12 is in a two-sectional or three-sectional form, and has a top end thereof fixed to the notch 13. The notch 13 is fastened with an inner tube 122, which has a rectangular fastening orifice 121 at an appropriate position for setting free a fastening button 17 disposed at the inner tube 122. The inner tube 122 is also penetrated through the runner 14, so as to allow the runner 14 with up-and-down sliding movements. When the umbrella 1 is stretched, the runner 14 is pushed upward to the fastening button 17 that further butts against a bottom portion of the runner 14, such that the main ribs 15 prop up the entire cover 11. The umbrella 1 is collapsed by pressing the fastening button 17.

As described above, although the prior umbrella 1 fulfills stretching and collapsing functions, a collapsed volume thereof is rather large because the shaft 12 is a two-sectional or three-sectional structure. The collapsed umbrella 1 is only suitably stored in larger handbags or backpacks but not in commonly used handbags. To reduce the volume of the umbrella 1, it is necessary to devise the shaft 12 as a multi-sectional design, with a difference between diameters of an outer tube and the inner tube of the shaft 12 being inevitably enlarged. When stretching the umbrella, a substantial space is left between the inner tube having the smallest diameter and the runner 14 having a diameter larger than that of the outer tube, so that undesired wavering of the shaft 12 relative to the runner 14 is resulted. Also, the fastening button 17 becomes unsecurely butted against the runner 14, and hence it is likely that the runner 14 fails to be firmly stretched for being frequently slipped off in a downward direction.

Referring to FIGS. 2 and 2A showing another prior umbrella 2, a shaft 22 is devised as a four-sectional or five-sectional design for reducing the volume of the umbrella 2. As appropriate, one or two ends where stretchers 25 come into contact with a runner 23 are inserted and extended with extension posts 27. When stretching the umbrella 2, the shaft 22 is upheld by the extension posts 27 through the runner 23 to keep the shaft 22 from undesired wavering. A fastening button 26 at the shaft 22 and a bottom portion of the runner 24 are allowed with a larger mutual supporting plane, thereby enabling the stretchers 25 connected with the runner 23 to prop up main ribs 24 that further stretch an entire cover 21. The umbrella 2 is collapsed by pressing the fastening button 26.

As described above, the prior umbrella 2 advances over the prior umbrella 1 by having a smaller volume. However, due to the extension posts 27 in the prior umbrella 2, pushing movements of the runner 23 are made unsmooth and unhandy since the shaft 22 is butted by the extension posts 27 when stretching the umbrella 2.

Referring to FIGS. 3 and 3A showing yet another prior umbrella 3, a shaft 31 is devised a multi-sectional design. At an appropriate position where an outer tube 312 of the shaft 31 is fixed to a notch 32, the shaft 31 is provided with a rectangular fastening orifice 311. An elastic fastening button 34 is also disposed for coordinating with one side of a runner 33, so as to complete stretching and collapsing of the umbrella 3. The elastic fastening button 34 has one end thereof formed as a hook portion 341, and the other end thereof formed as a pressing plane 342. Underneath the pressing plane 342 is a spring 343. When stretching the umbrella 3, the runner 33 is pushed upward, and the rectangular fastening orifice 311 provided at the outer tube 312 is locked by a hook portion 341 of the elastic fastening button 34 at the runner 33. When collapsing the umbrella 3, by pressing the pressing plane 342 at one end of the elastic fastening button 34, the hook portion 341 is disengaged from the rectangular fastening orifice 311 due to actions of the spring 343, thereby collapsing the umbrella 3.

As described above, although the elastic fastening button 34 of the prior umbrella 3 also fulfills stretching and collapsing functions of the umbrella 3, the issue of a fastening button being incapable of securely locking the runner due to a reduced volume of the umbrella remains unsolved. Therefore, in the view of the aforesaid drawbacks, it is a vital task of the invention to provide an umbrella structure, which not only overcomes the aforesaid drawbacks but also offers usage conveniences as well as industrial values.

SUMMARY OF THE INVENTION

The primary object of the invention is to provide an umbrella structure having a fixing portion, so as to overcome a drawback of the prior invention with a fastening device being incapable of securely locking a fastening orifice due to a reduced volume of an umbrella.

The secondary object of the invention is to provide an umbrella structure having a fixing portion, which reinforces strength of the umbrella against external forces, and prevents damages and deformations of an inner tube of a shaft by offering the shaft with appropriate protection.

An umbrella structure according to the invention comprises a cover, a shaft, a notch, a runner, main ribs and stretchers. The notch is extended downward to form a fixing portion. The fixing portion has one end thereof disposed with a protruding loop section, and an appropriate position thereof disposed with a fastening orifice for corresponding with the protruding button. The runner is accommodated at the fixing portion, and is capable of up-and-down sliding movements at the fixing portion. When stretching the umbrella, the protruding button at the fastening device is securely locked at the fastening orifice at the fixing portion to smoothly stretch the umbrella. When collapsing the umbrella, the shaft is stored in the fixing portion to prevent the shaft from damages and deformations by offering the shaft with appropriate protection. Using the aforesaid structure, a drawback as being incapable of securely stretching the umbrella due to reduced volume of the umbrella is solved.

DETAILED DESCRIPTION OF THE PREFERRED EMBODIMENTS

To better understand the effects, structure and characteristics of the invention, detailed descriptions of preferred embodiments shall be given with the accompanying drawings below.

Figure 1:
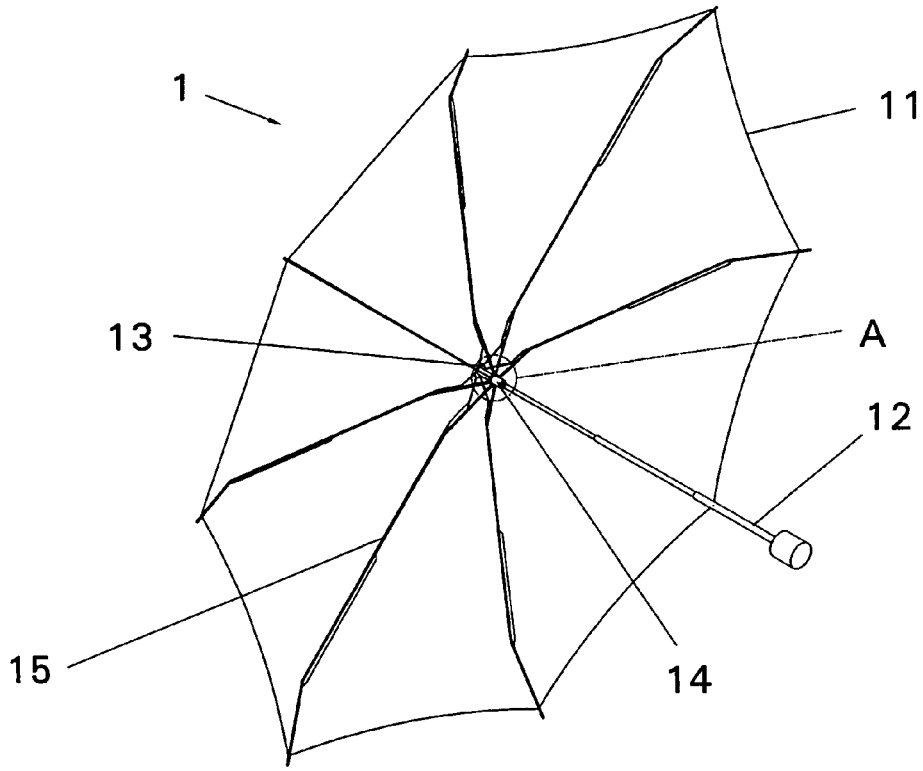
FIG.1 Prior Art
FIG. 1 shows a conventional schematic view of a prior umbrella being stretched.
Figure 1A:
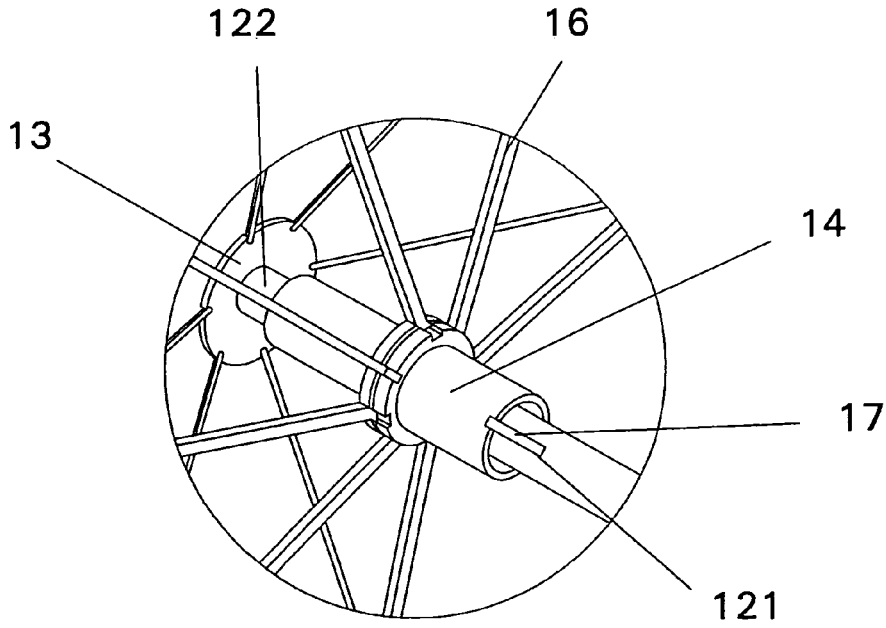
FIG.1A Prior Art
FIG. 1A shows a conventional enlarged partial view of the prior umbrella in FIG. 1.
Figure 2:
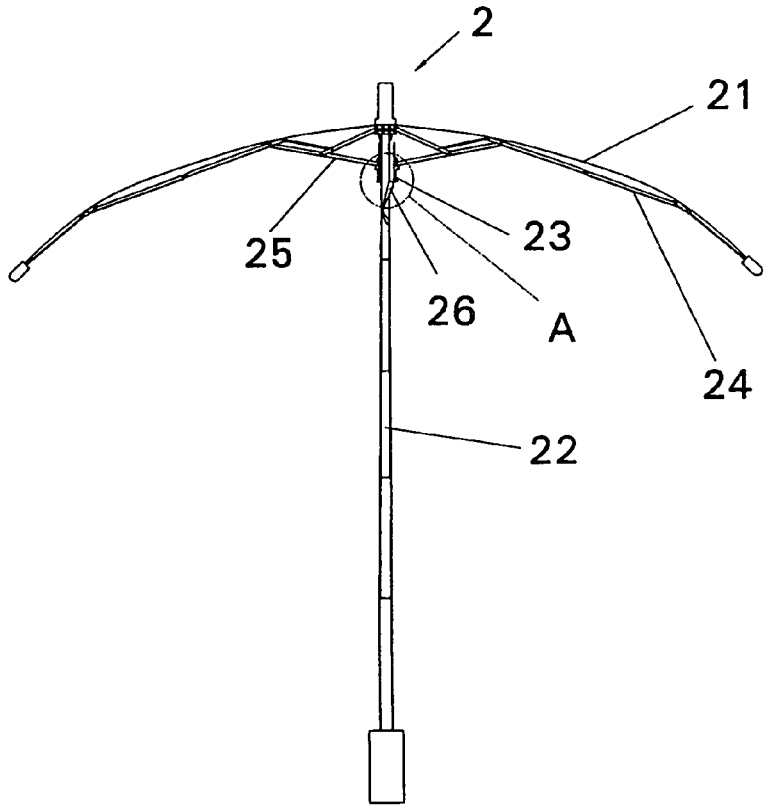
FIG.2 Prior Art
FIG. 2 shows a conventional schematic view of another prior umbrella being stretched.
Figure 2A:
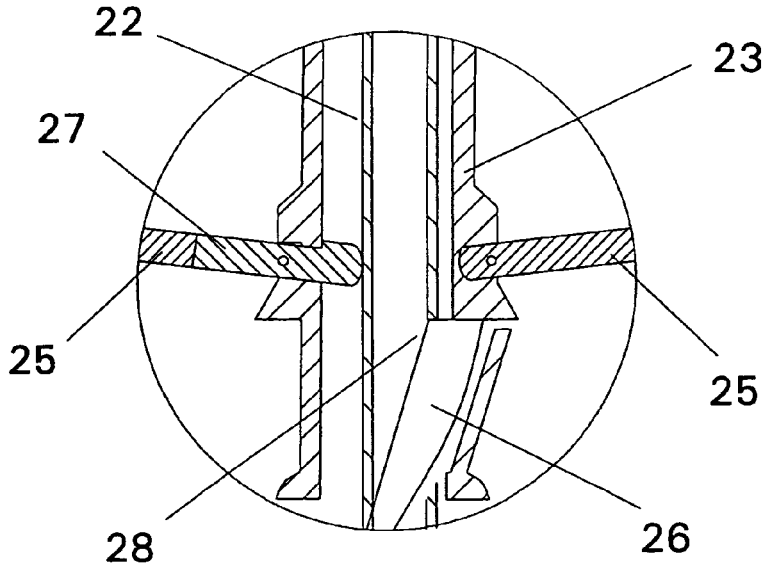
FIG.2A Prior Art
FIG. 2A shows a conventional enlarged partial view of the prior umbrella in FIG. 2.
Figure 3:
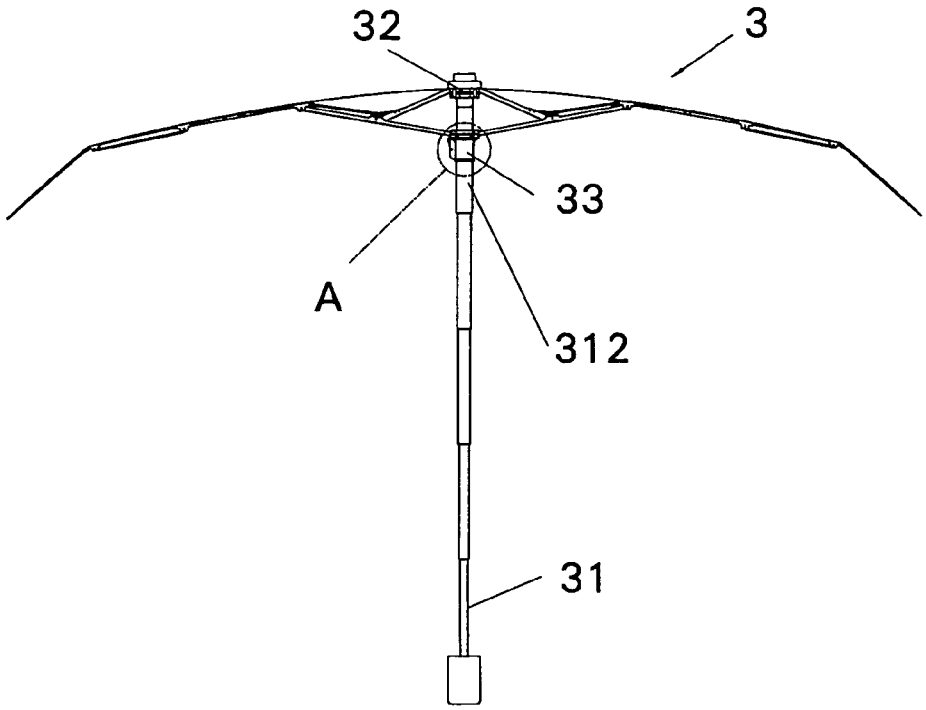
FIG.3 Prior Art
FIG. 3 shows a conventional schematic view of yet another prior umbrella being stretched.
Figure 3A:
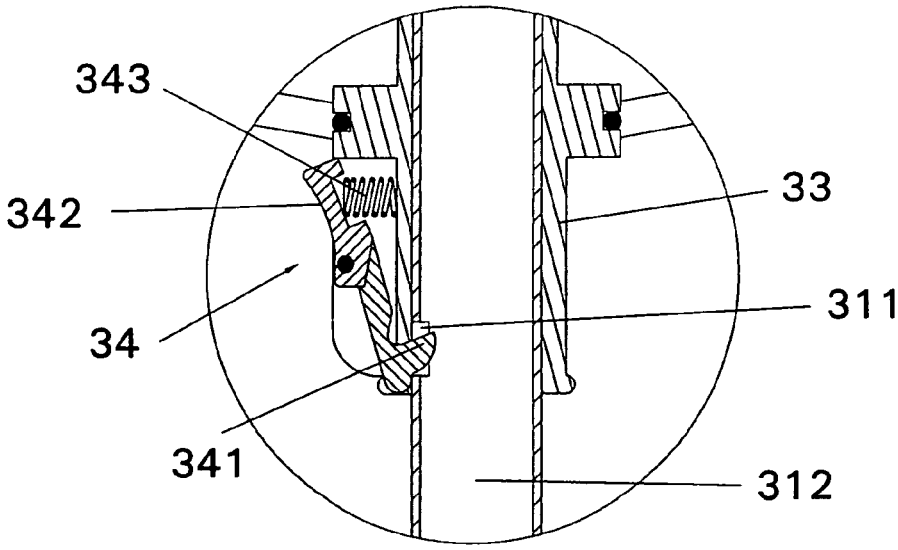
FIG.3A Prior Art
FIG. 3A shows a conventional enlarged partial view of the prior umbrella in FIG. 3.
Figure 4:
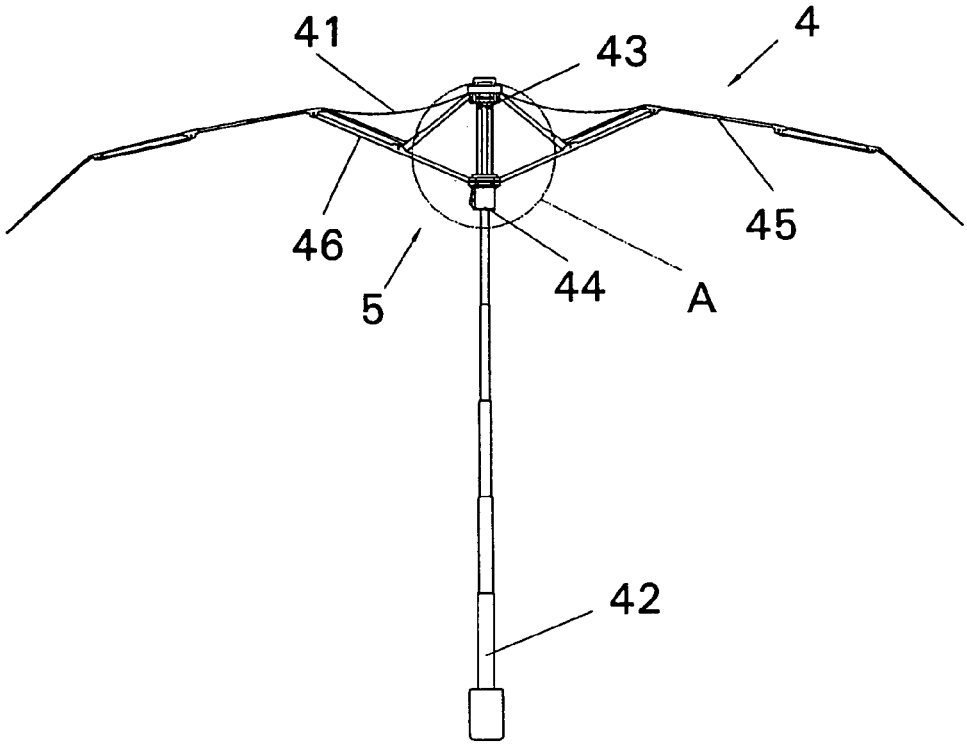
FIG. 4 shows a first schematic view illustrating stretching movements according to the invention.
Figure 4A:
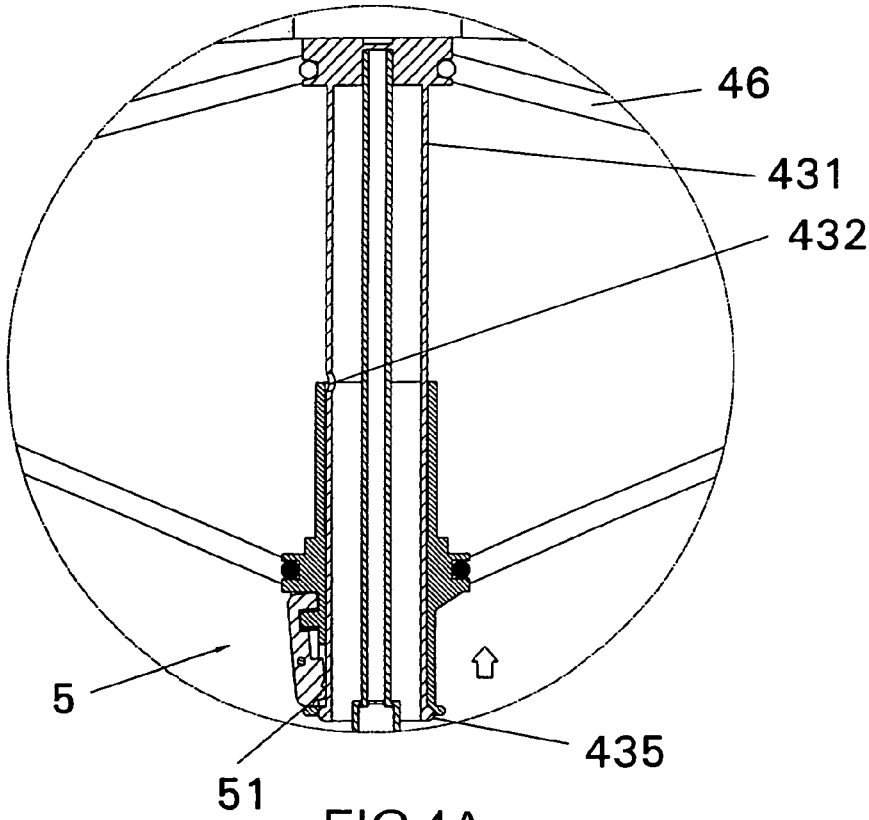
FIG. 4A shows a first enlarged partial view illustrating stretching movements of the umbrella according to the invention.
Figure 5:
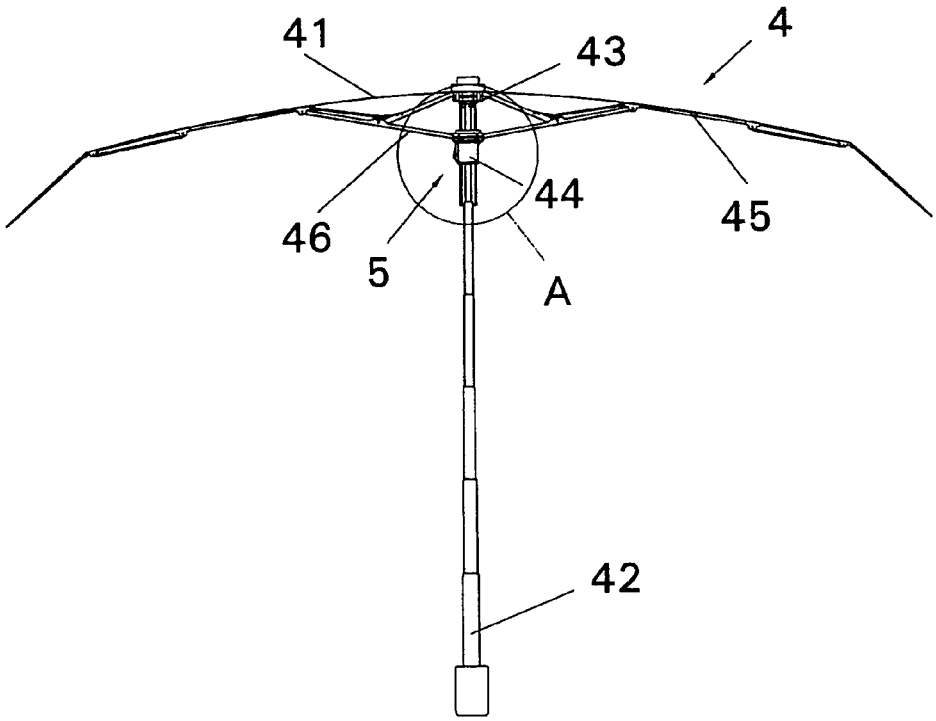
FIG. 5 shows a second schematic view illustrating stretching movements of the umbrella according to the invention.
Figure 5A:
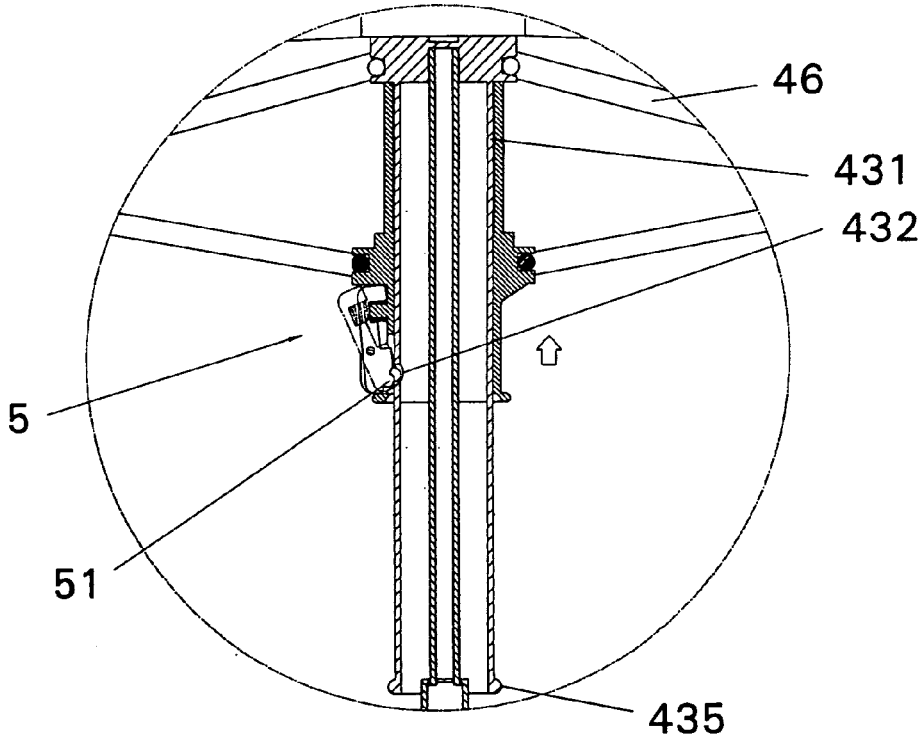
FIG. 5A shows a second enlarged partial view illustrating stretching movements of the umbrella according to the invention.
Figure 6:
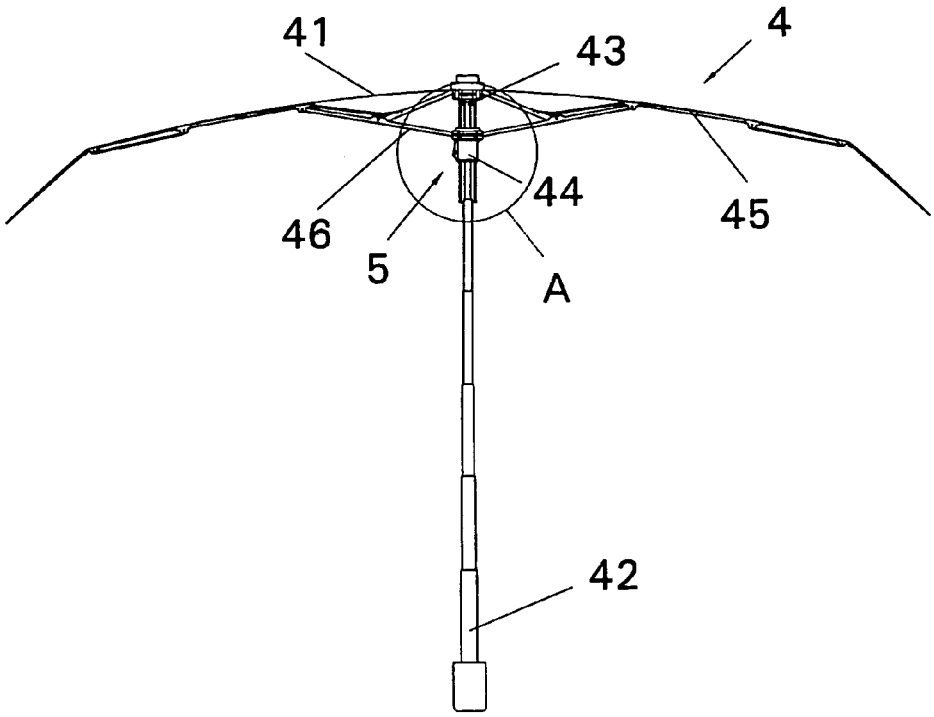
FIG. 6 shows a first schematic view illustrating collapsing movements of the umbrella according to the invention.
Figure 6A:
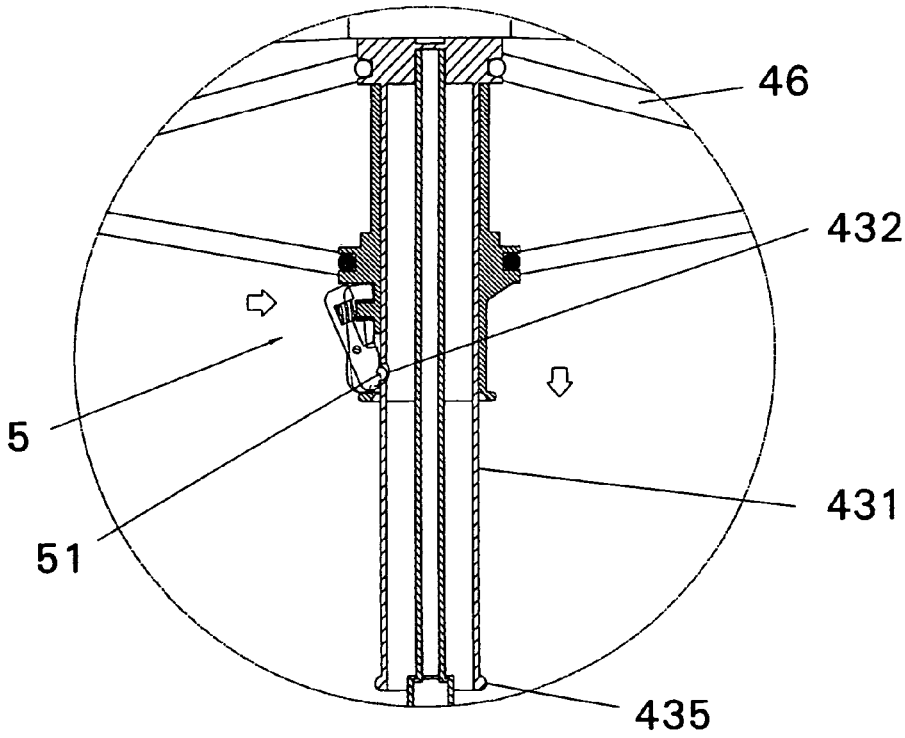
FIG. 6A shows a first enlarged partial view illustrating collapsing movements of the umbrella according to the invention.
Figure 7:
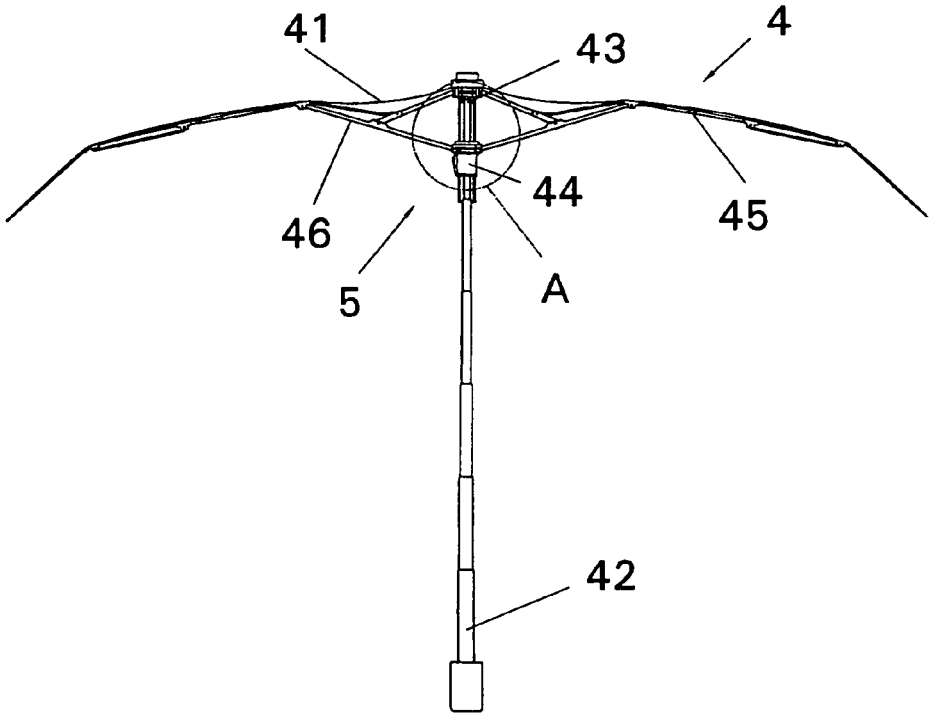
FIG. 7 shows a second schematic view illustrating collapsing movements of the umbrella according to the invention.
Figure 7A:
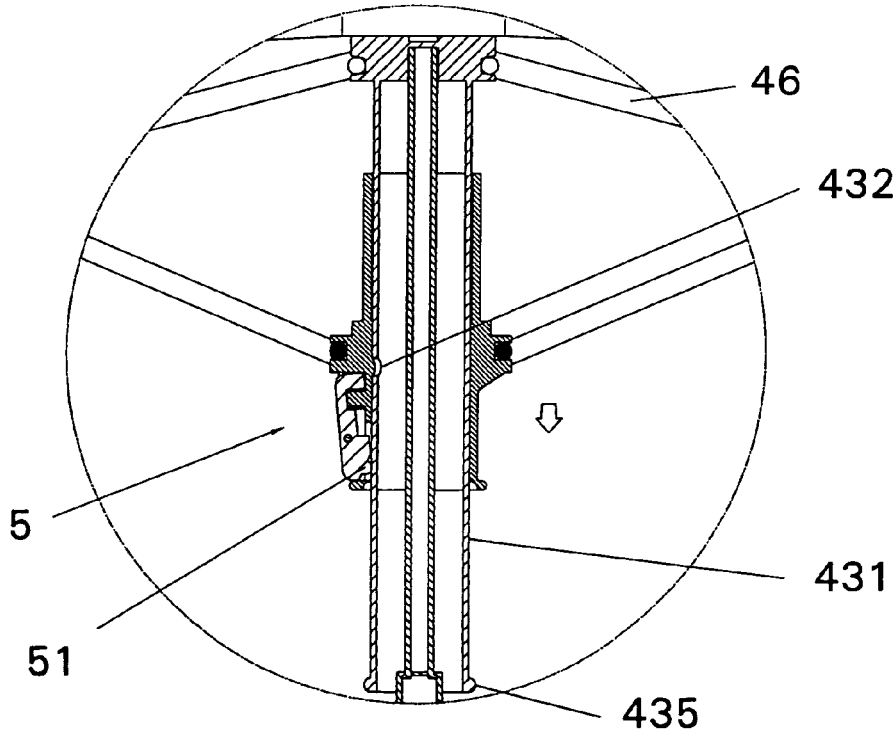
FIG. 7A shows a second enlarged partial view illustrating collapsing movements of the umbrella according to the invention.
Figure 8:
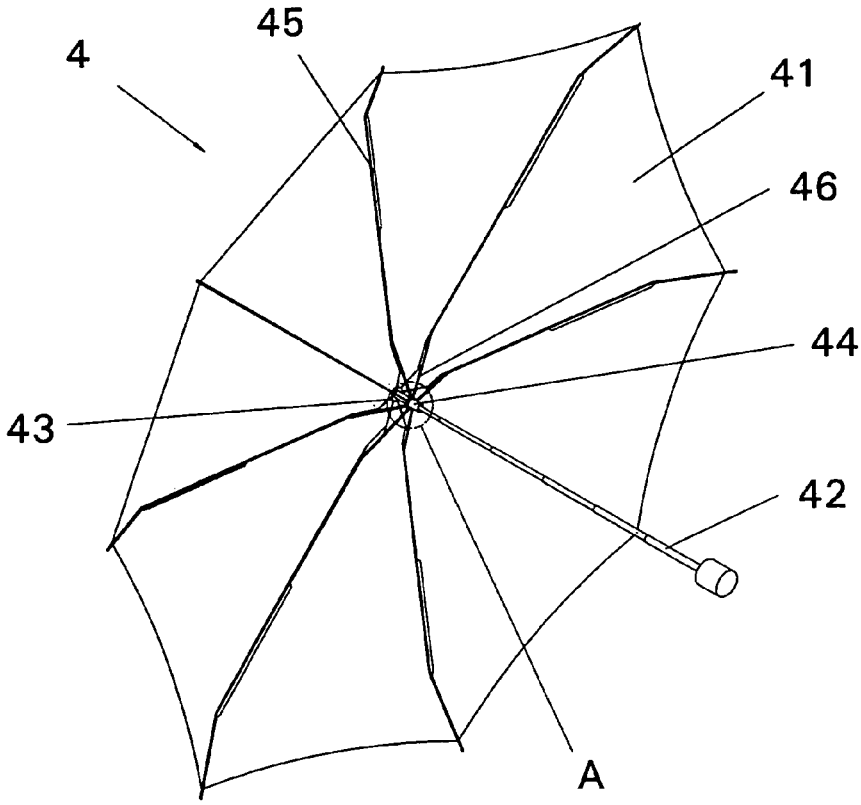
FIG. 8 shows an elevational view illustrating the stretched umbrella according to the invention.
Figure 8A:
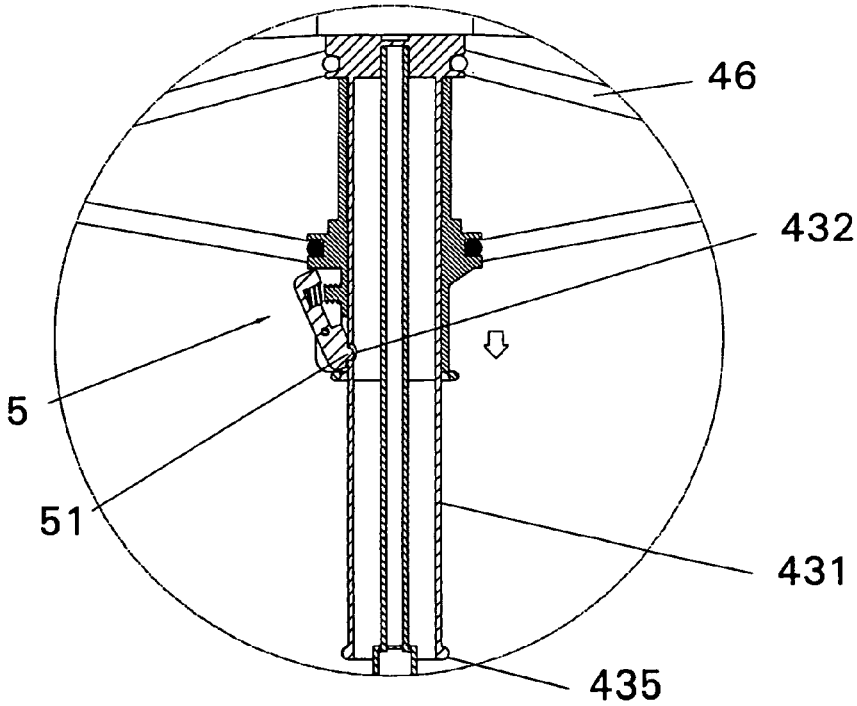
FIG. 8A shows an enlarged sectional side view illustrating the fastening device according to the invention.

Referring to FIGS. 8 and 8A, an umbrella 4 according to the invention comprises a cover 41, a shaft 42, a notch 43, a runner 44, main ribs 45 and stretchers 46. Around the notch 43 is a plurality of pivotally disposed main ribs 45 for supporting the cover 41. Around the runner 44 is a plurality of pivotally disposed stretchers 45 for supporting the ribs 45. One side of the runner 44 is provided with a fastening device 5 having a protruding button 51. The shaft 42 is devised as a multi-sectional structure and is fastened at a center of the notch 43. The notch 43 is extended downward to form a fixing portion 431. The fixing portion 431 has one end thereof disposed with a protruding loop section 435, and an appropriate position thereof disposed with a fastening orifice 432 for corresponding with the protruding button 51. The runner 44 is accommodated at the fixing portion 431, and is capable of up-and-down sliding movements at the fixing portion 431. When stretching the umbrella, the protruding button 51 at the fastening device 5 is steadily locked at the fastening orifice 432 at the fixing portion 431 to smoothly stretch the umbrella. When collapsing the umbrella, the shaft 42 is stored in the fixing portion 431 to prevent the shaft 42 from damages and deformations by offering the shaft 42 with appropriate protection. Using the aforesaid structure, the drawback as being incapable of securely stretching the umbrella due to a reduced volume of the umbrella is solved.

As described above and with reference to FIGS. 4, 4A, 5 and 5A, to stretch the umbrella according to the invention, the runner 44 is pushed upward. At this point, the protruding button 51 at the fastening device 5 is fastened with the fastening orifice 432 at the fixing portion 431, so that the stretchers 46 connected with the runner 44 are enable to support the main ribs 45 that further support the entire cover 41, thereby completing stretching of the umbrella. To collapse the umbrella, as shown in FIGS. 6, 6A, 7 and 7A, when a force is applied to the fastening device 5 by a user, the protruding button 51 at the fastening device 5 is lifted to disengage from the fastening orifice 432 at the fixing portion 431. Thus, the runner 44 is slid downward to reach the protruding loop section 435. The user ceases applying a force to the fastening device 5 at this point, with the shaft 42 restored into the fixing portion 431 for completing collapsing of the umbrella.

Figure 9A:
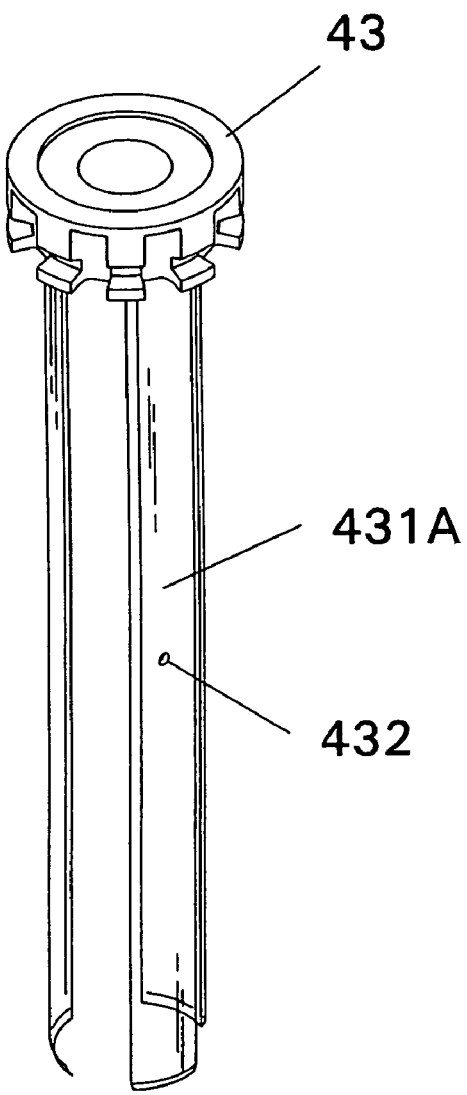
FIG. 9A shows an elevational view illustrating the fixing portion and the notch in another embodiment according to the invention.
Figure 9:
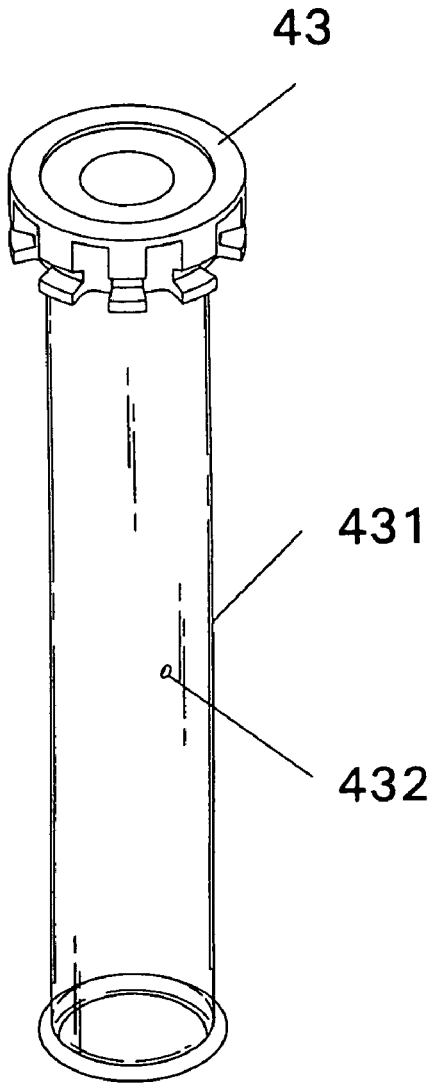
FIG. 9 shows an elevational view of the fixing portion at the notch according to the invention.
Figure 9B:
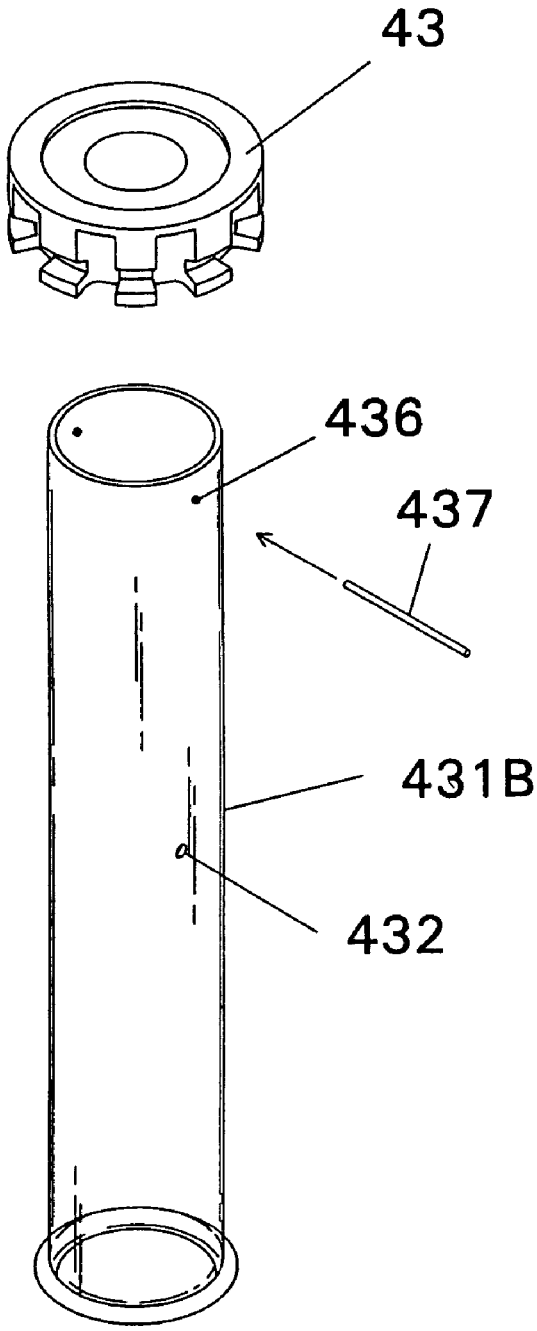
FIG. 9B shows an elevational view illustrating the fixing portion and the notch in yet another embodiment according to the invention.

Referring to FIG. 9A showing the fixing portion of the notch in another embodiment according to the invention, the notch 43 is extended downward to form a fixing portion 431A that may be a plate-like body. At an appropriate position, the fixing portion 431A is similarly provided with a fastening orifice 432 for corresponding with the protruding button 51 at the fastening device 5. Referring to FIG. 9B showing the fixing portion of the notch in yet another embodiment according to the invention, one end of the notch 43 is joined with a fixing portion 431B via a pin 437. One end of the fixing portion 431 is provided with an opening 436 for inserting the pin 437. At an appropriate position, the fixing portion 431*b*B is similarly provided with a fastening orifice 432 for corresponding with the protruding button 51 at the fastening device 5.

Figure 10:
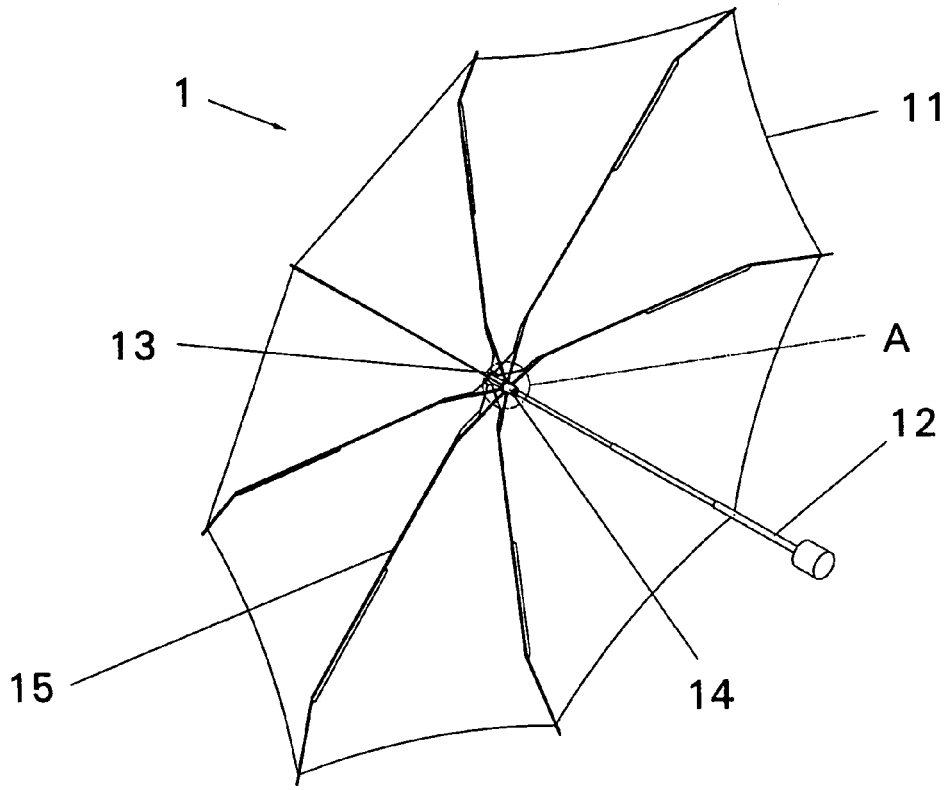
FIG. 10 shows a schematic view illustrating the stretched umbrella using another design of the fixing portion and the runner according to the invention.
Figure 10A:
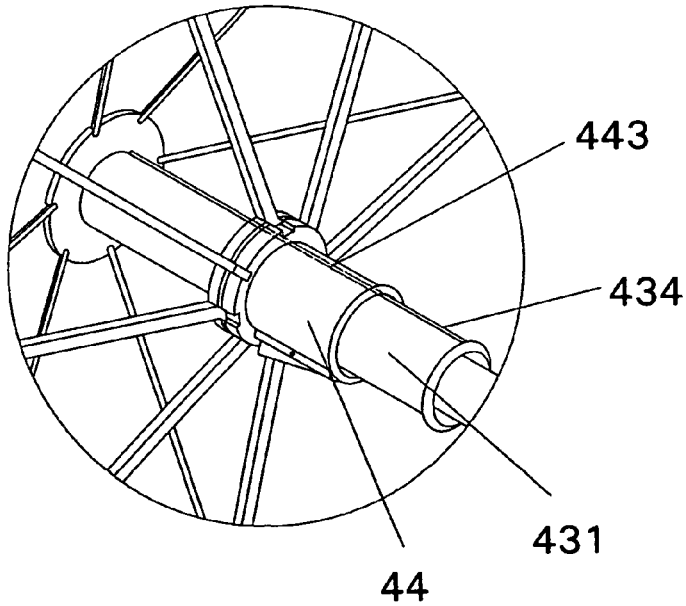
FIG. 10A shows an enlarged view illustrating the fixing portion fastened with the runner according to the invention.
Figure 10B:
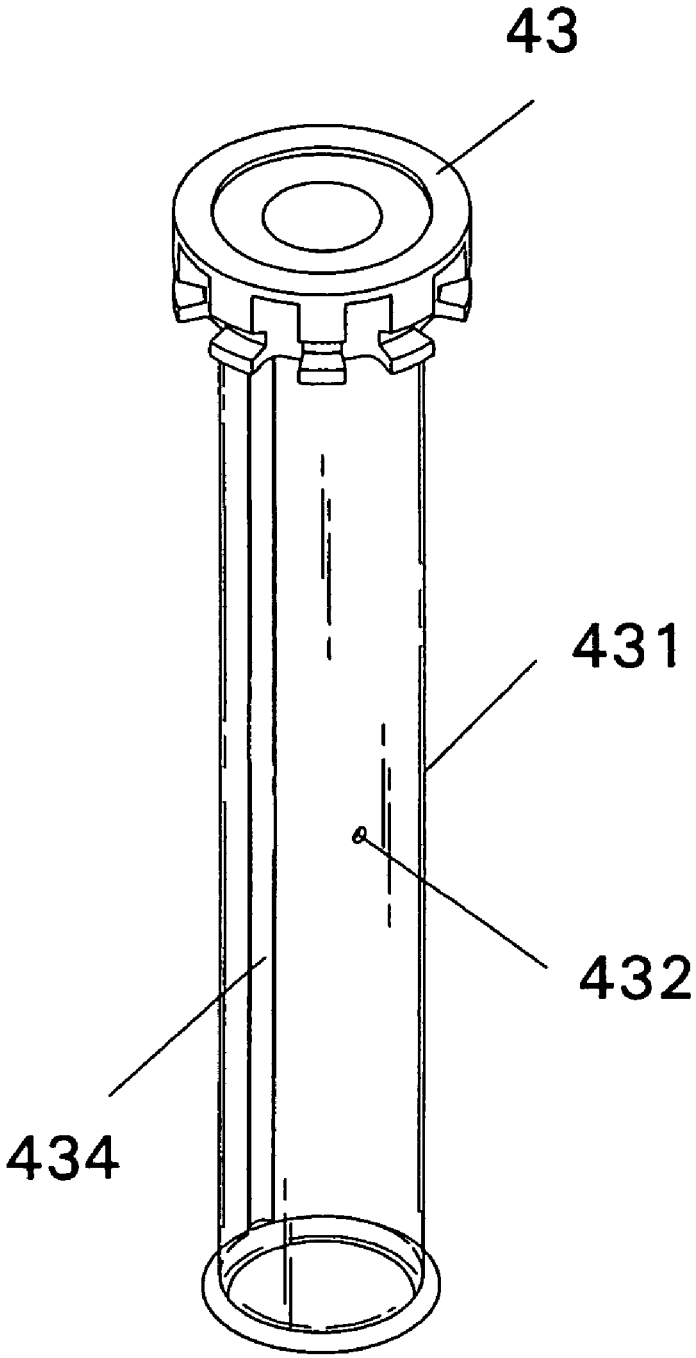
FIG. 10B shows an elevational view of the fixing portion in another embodiment according to the invention.

Referring to FIGS. 10, 10A and 10B showing the fixing portion of the notch in yet another embodiment according to the invention, at an appropriate position, the fixing portion 431 is disposed with a track 434, and an inner side of the runner 44 is disposed with a sliding channel 443 for embedding with the track 434. Thus, the runner 44 is smoothly guided into the fixing portion 431 using the sliding channel 443, so as to fasten the protruding button 51 at the fastening device 5 with the fastening orifice 432 at the fixing portion 431.

Figure 11:
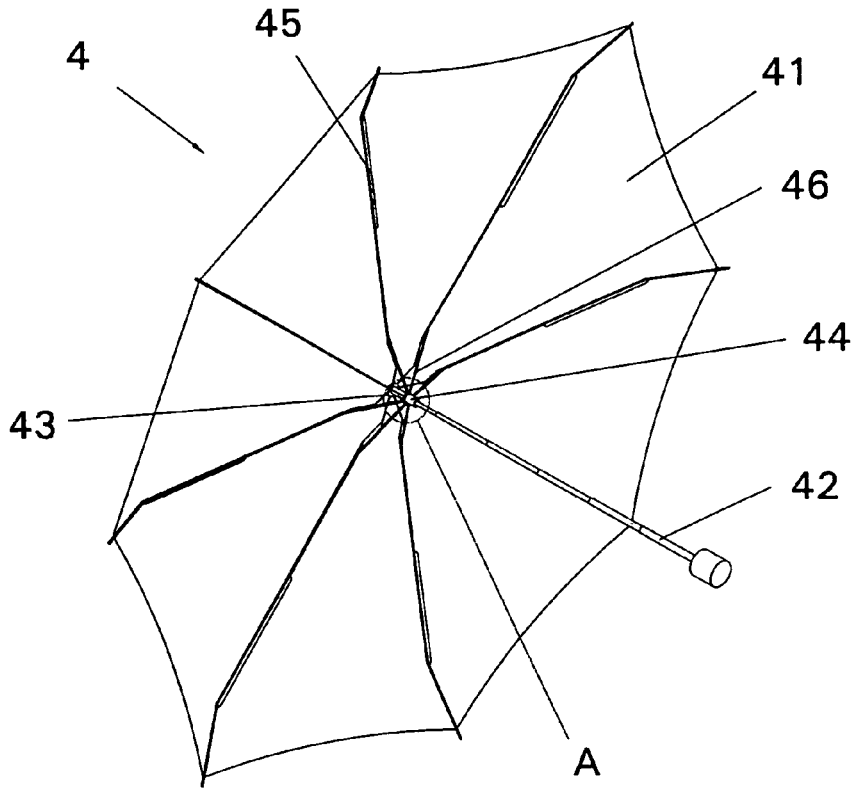
FIG. 11 shows a schematic view illustrating the stretched umbrella using another design of the fastening device according to the invention.
Figure 11A:
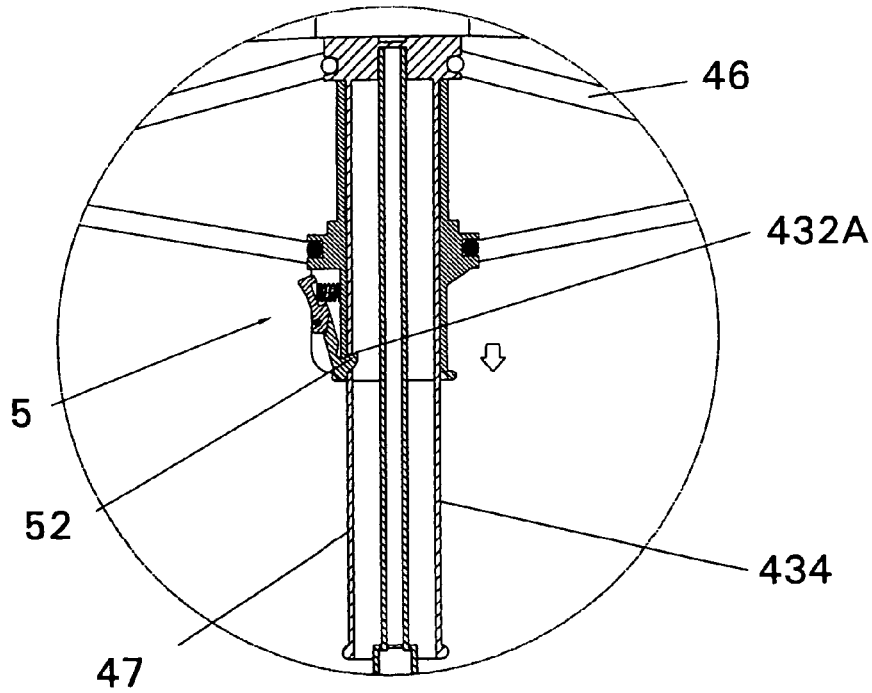
FIG. 11A shows a structural schematic view illustrating yet another design of the fastening device according to the invention.

FIGS. 11 and 11A show structural schematic views illustrating the fastening device in another embodiment according to the invention. An appropriate position of the side of the runner 44 is provided with a fastening device 5A in shape of a hook 52. At an appropriate position, the fixing portion

431 is similarly provided with a fastening orifice 432A for corresponding with the hook 52.

Conclusive from the above, the invention has the following excellences:

1. Using the fixing portion according to the invention, a drawback as the fastening device being incapable of securely locking the fastening orifice due to a reduced volume of the umbrella is solved.
2. Using the fixing portion serving as a butting point of the protruding button, strength of the umbrella against external forces is increased, while also preventing the shaft from damages and deformations by offering the shaft with appropriate protection.
3. Using the sliding channel in the runner and the track at the fixing portion, the protruding button at the runner is precisely guided into the fastening orifice at the fixing portion of the notch when stretching the umbrella, thereby avoiding damages of the runner and the fixing portion of the notch due caused by improper guiding movements.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An umbrella, comprising:

a plurality of pivotally disposed main ribs around a notch for supporting a cover, wherein said notch extends downward to form an elongate fixing portion to receive a runner, said runner comprises a fastening device having a protruding button and slides up-and-down on said fixing portion, wherein said fixing portion includes a fastening orifice for receiving said protruding button to stretch the umbrella in an opening position;

a plurality of stretchers around said runner for supporting said plurality of pivotally disposed main ribs; and a collapsible shaft fastened to said notch and extending downward through said fixing portion to form a space between said shaft and said fixing portion, and said collapsible shaft having a multi-sectional structure;

wherein stretching said umbrella can lock said protruding button at said fastening orifice and collapsing said umbrella can permit storing said multi-sectional structure of said collapsible shaft within said space of said fixing portion.

2. An umbrella according to claim 1, wherein said fixing portion comprises a track and said runner forms a sliding channel to receive said track thereby guiding said runner along said fixing portion.

3. An umbrella according to claim 1, wherein said fixing portion is a separate element being jointed to said notch.

4. An umbrella according to claim 1, wherein said fixing portion is a plurality of plates.

5. An umbrella according to claim 1, wherein one end of said fixing portion forms a protruding loop section.

6. An umbrella according to claim 1, wherein said fastening orifice is round, rectangular, triangular or oval-shaped suitable for fastening.

7. An umbrella according to claim 1, wherein said fixing portion forms an opening for receiving a pin to join said fixing portion to said notch.

* * * * *